US010468808B2

(12) United States Patent
Duan et al.

(10) Patent No.: US 10,468,808 B2
(45) Date of Patent: Nov. 5, 2019

(54) ELECTRICAL PLUG CONNECTOR WITH TERMINAL CONTACT TO SHIELDING SHELL PREVENTION MEANS

(71) Applicant: Advanced Connectek Inc., New Taipei (TW)

(72) Inventors: Shu-Lin Duan, New Taipei (TW); Wei Wan, New Taipei (TW); Fei-Wu Dong, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 0 days.

(21) Appl. No.: 15/997,727

(22) Filed: Jun. 5, 2018

(65) Prior Publication Data

US 2018/0351282 A1 Dec. 6, 2018

(30) Foreign Application Priority Data

Jun. 6, 2017 (CN) ..... 2017 1 0416992

(51) Int. Cl.

| | |
|---|---|
| ***H01R 24/60*** | (2011.01) |
| ***H01R 13/502*** | (2006.01) |
| ***H01R 13/26*** | (2006.01) |
| ***H01R 13/6585*** | (2011.01) |
| ***H01R 13/6583*** | (2011.01) |
| *H01R 13/6581* | (2011.01) |
| *H01R 24/70* | (2011.01) |
| *H01R 13/6594* | (2011.01) |

(Continued)

(52) U.S. Cl.

CPC ..... *H01R 13/502* (2013.01); *H01R 13/26* (2013.01); *H01R 13/6583* (2013.01); *H01R 13/6585* (2013.01); *H01R 12/727* (2013.01); *H01R 13/56* (2013.01); *H01R 13/6581* (2013.01); *H01R 13/6591* (2013.01); *H01R 13/6594* (2013.01); *H01R 24/60* (2013.01); *H01R 24/70* (2013.01)

(58) Field of Classification Search

CPC ..... H01R 23/6873; H01R 13/6594; H01R 24/60; H01R 13/6591; H01R 12/727; H01R 13/6581; H01R 13/56; H01R 24/70

USPC ..... 439/660, 676, 607.35, 607.4, 607.31, 439/607.32

See application file for complete search history.

(56) References Cited

U.S. PATENT DOCUMENTS

| | | | | |
|---|---|---|---|---|
| 9,742,123 | B2 * | 8/2017 | Yokoyama | H01R 13/648 |
| 9,882,323 | B2 * | 1/2018 | Tziviskos | H01R 13/6585 |
| 2016/0149348 | A1 * | 5/2016 | Kao | H01R 13/6585 439/607.05 |

* cited by examiner

*Primary Examiner* — Abdullah A Riyami
*Assistant Examiner* — Justin M Kratt
(74) *Attorney, Agent, or Firm* — JCIPRNET

(57) ABSTRACT

An electrical plug connector includes a plurality of terminals and an insulator, a pair of grounding latches, a shielding spring and a shielding shell. Each of the terminals has a contacting segment and an elastic segment. Each of the contacting segments has a stopping face. The insulator partially covers the terminals and has a plurality of stopping edges. When the electrical plug connector is inserted into an electrical receptacle connector, shape deformation of each of the elastic segments shifts the corresponding contacting segment until the corresponding stopping edge is against the corresponding stopping face, and each contacting segment does not protrude from the insulator. When the electrical plug connector is not inserted into the electrical receptacle connector, shape recovery of each of the elastic segments restores the corresponding contacting segment and the corresponding stopping edge is away from the stopping face.

10 Claims, 7 Drawing Sheets

(51) Int. Cl.

| | |
|---|---|
| *H01R 13/6591* | (2011.01) |
| *H01R 13/56* | (2006.01) |
| *H01R 12/72* | (2011.01) |

ELECTRICAL PLUG CONNECTOR WITH TERMINAL CONTACT TO SHIELDING SHELL PREVENTION MEANS

CROSS-REFERENCE TO RELATED APPLICATION

This application claims the priority benefit of China patent application serial no. 201710416992.X, filed on Jun. 6, 2017. The entirety of the above-mentioned patent application is hereby incorporated by reference herein and made a part of the specification.

BACKGROUND

Field of the Disclosure

The disclosure is related to an electrical connector, and particularly to an electrical plug connector.

Description of Related Art

An electrical connector is a component commonly used for electronic devices, and can be connected with a matching electrical connector of other electronic devices to serve as a signal and power transmitting medium. Common electrical connectors include, for example, universal serial bus (USB) electrical connector. Currently, a new TYPE-C electrical connector specification is introduced to USB protocol, which not only allows data transmission with 10 Gbps of ultra-high speed rate, but the insertion port thereof is symmetrical, thus allowing reversible connection, such an electrical connector is widely applied in various electronic devices such as notebook computers.

In terms of the USB TYPE-C electrical plug connector, in order to ensure that the contacting end of a terminal located in an insulator does not pass through the opening of the insulator and contact the shielding shell after being shifted, typically an insulating film is adhered to the insulator to block an opening of the insulator. By being blocked with the insulating film, the terminal is not directly in contact with the shielding shell after being shifted due to the pressure applied by a tongue portion of a corresponding electrical receptacle connector. However, the insulating film has defects as follows. It takes more time to adhere the insulating film. After the insulating film has been used for a period of time, it easily comes off because the viscosity of insulating film decreases. The insulating film is easily cracked due to friction caused by the contacting end of the terminal and thus causing failure of insulation.

SUMMARY

The disclosure provides an electrical plug connector which can, in the absence of the insulating film, ensure that the contacting end of the terminal located in the insulator does not pass through the opening of the insulator and contact the shielding shell after being shifted.

In the disclosure, an electrical plug connector is adapted to be inserted into an electrical receptacle connector. The electrical plug connector includes a plurality of terminals, an insulator, a pair of grounding latches, a shielding spring and a shielding shell. Each of the terminals has a contacting segment and an elastic segment. Each of the contacting segments has a stopping face. The insulator partially covers the terminals and has a plurality of stopping edges. When the electrical plug connector is inserted into the electrical receptacle connector, shape deformation of each of the elastic segments shifts the corresponding contacting segment until the corresponding stopping edge is against the corresponding stopping face, and each of the contacting segments does not protrude from the insulator. When the electrical plug connector is not inserted into the electrical receptacle connector, shape recovery of each of the elastic segments restores the corresponding contacting segment and the corresponding stopping edge is away from the corresponding stopping face. The pair of the grounding latches is installed to the insulator and respectively located on both sides of the terminals to be latched with the electrical receptacle connector. The shielding spring is installed to the insulator to contact the electrical receptacle connector. The shielding shell accommodates the terminals, the insulator, the pair of grounding latches and the shielding spring.

In an embodiment of the disclosure, the insulator has a plurality of openings, and one end of each of the openings adjacent to the interior of the insulator forms the corresponding stopping edge.

In an embodiment of the disclosure, when the electrical plug connector is inserted into the electrical receptacle connector, each of the contacting segments is moved in a space enclosed by the corresponding opening. When the electrical plug connector is not inserted into the electrical receptacle connector, each of the contacting segments is moved out of the space enclosed by the corresponding opening.

In an embodiment of the disclosure, the insulator has a fitting protrusion. The shielding spring has a fitting slot. The fitting protrusion fits with the fitting slot, and one end of the openings away from the interior of the insulator is located at the fitting protrusion.

In an embodiment of the disclosure, the electrical plug connector further includes a shielding plate installed to the insulator, the terminals comprise a plurality of first terminals and a plurality of second terminals and the shielding plate is located between the first terminals and the second terminals.

In an embodiment of the disclosure, the shielding plate and the pair of grounding latches are formed integrally and hence the shielding plate is a grounding plate.

In an embodiment of the disclosure, the terminals include a plurality of first terminals and a plurality of second terminals. The insulator includes a first rear insulating portion, a second rear insulating portion and a front insulating portion. The first rear insulating portion retains the first terminals, the second rear insulating portion retains the second terminals, and the first rear insulating portion and the second rear insulating portion are assembled with each other and then the first rear insulating portion and the second rear insulating portion are assembled into the front insulating portion such that the first terminals and the second terminals are accommodated in the front insulating portion.

In an embodiment of the disclosure, the terminals include a plurality of first terminals and a plurality of second terminals. The insulator includes a first insulating portion and a second insulating portion. The first terminals are fixed on the first insulating portion, the second terminals are fixed on the second insulating portion, and the first insulating portion and the second insulating portion are assembled together.

In an embodiment of the disclosure, each of the terminals has a fixing segment and a soldering segment, and the elastic segment is located between the corresponding contacting segment and the corresponding fixing segment.

In summary, according to the disclosure, the contacting segment of the terminal is shifted until the stopping edge of the insulator is against the stopping face of the contacting segment such that the contacting segment does not protrude from the insulator to avoid contacting the shielding shell. In this manner, as compared with related art, the disclosure does not require the insulating film, and thus the problems caused by use of insulating film to block the contacting segment of the terminal from the shielding shell can be avoided.

In order to make the aforementioned features and advantages of the disclosure more comprehensible, embodiments accompanying figures are described in detail below.

DESCRIPTION OF EMBODIMENTS

Figure 1:
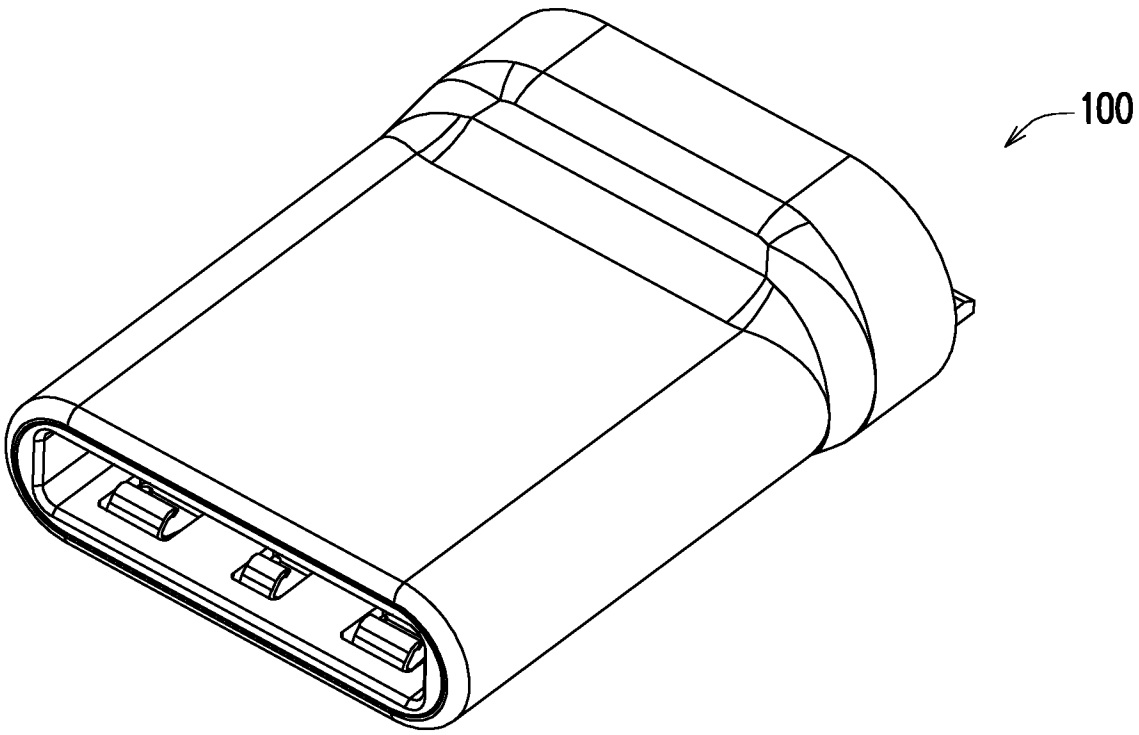
FIG. 1 is a perspective view of an electrical plug connector according to an embodiment of the disclosure.
Figure 2:
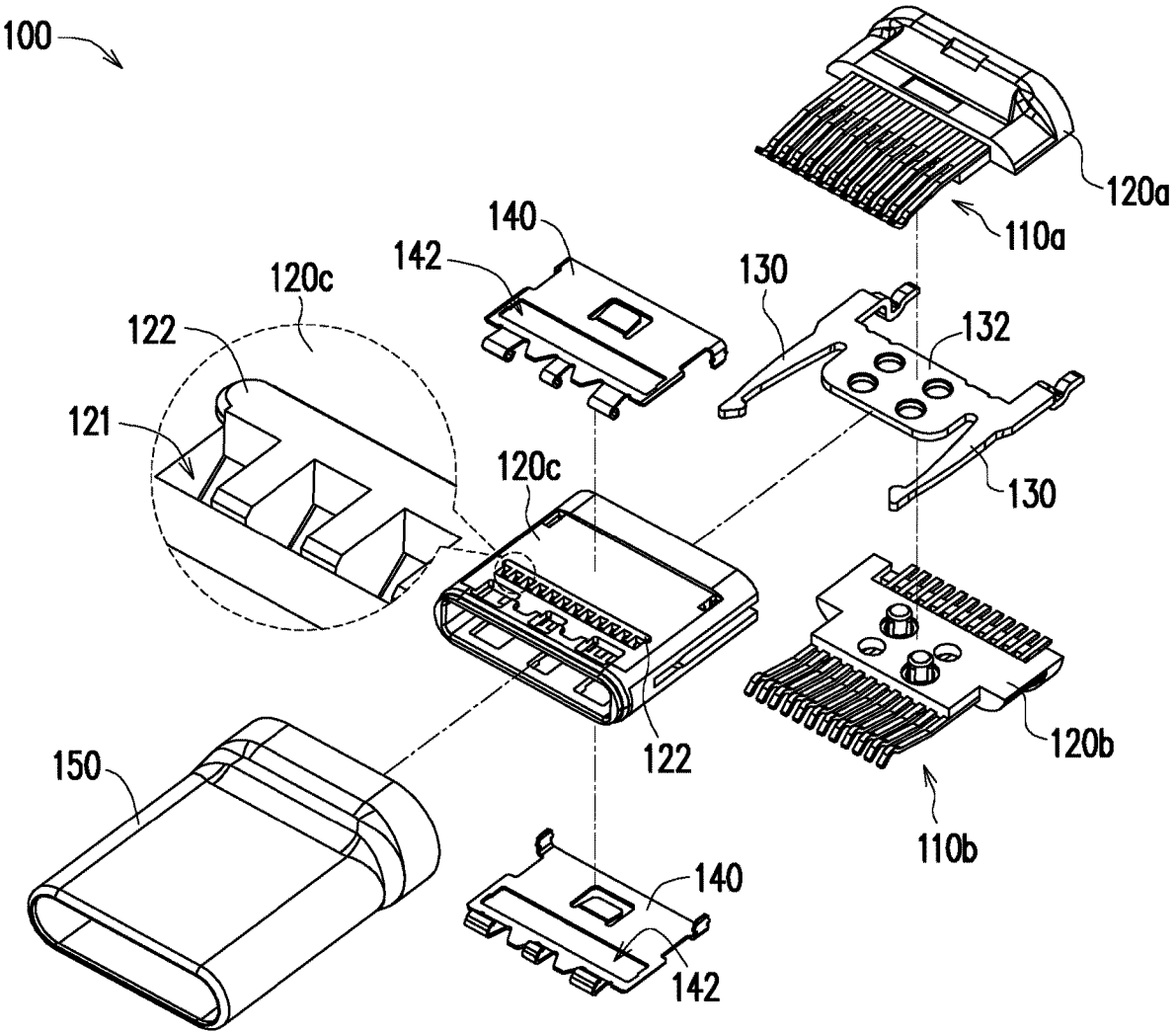
FIG. 2 is an explosive perspective view of the electrical plug connector in FIG. 1.
Figure 3:
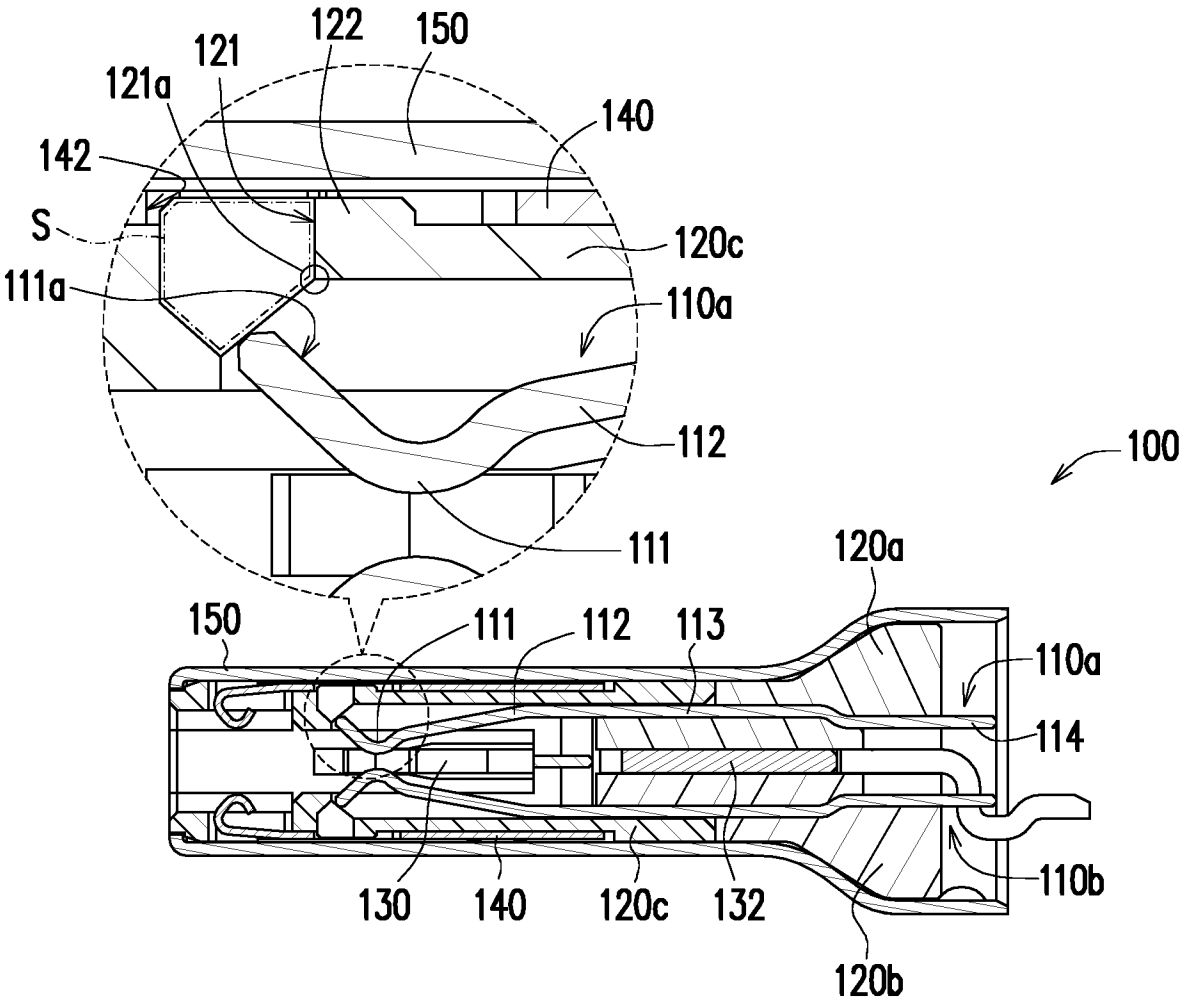
FIG. 3 is a cross-sectional view of the electrical plug connector in FIG. 1.
Figure 4:
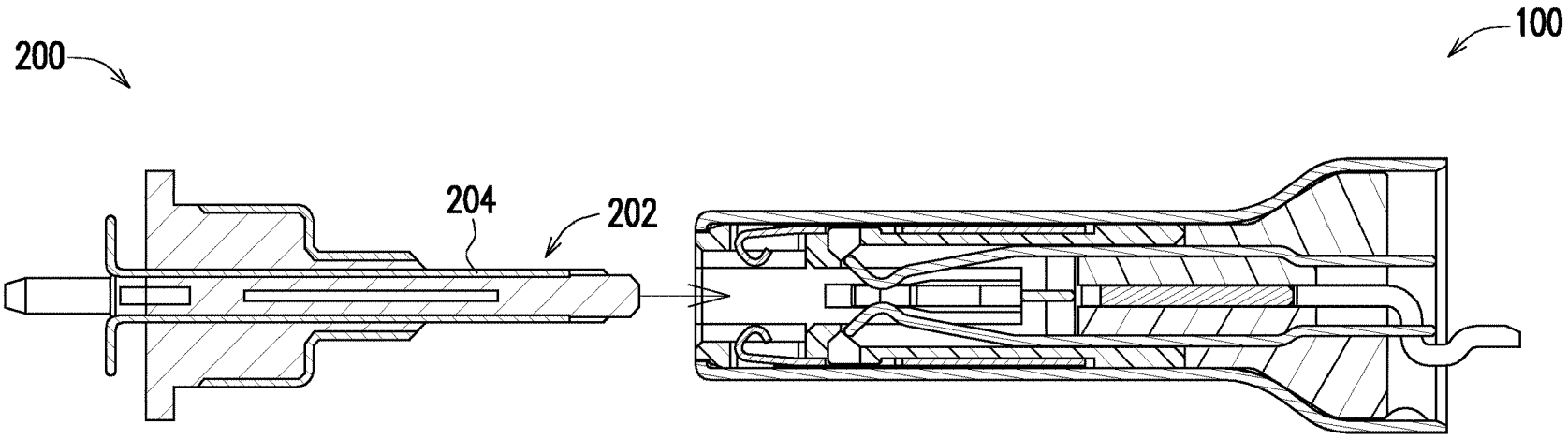
FIG. 4 is a cross-sectional view of the electrical plug connector in FIG. 3 inserted into an electrical receptacle connector.

Referring to FIG. 1, FIG. 2 and FIG. 3, an electrical plug connector 100 in the embodiment is adapted to be inserted into an electrical receptacle connector 200 (as shown in FIG. 4). The electrical plug connector 100 is, for example, compliant with USB TYPE-C standard. The electrical plug connector 100 includes a plurality of terminals and an insulator partially covering the terminals. In the embodiment, the terminals include a plurality of first terminals 110*a* and a plurality of second terminals 110*b*, and the insulator includes a first rear insulating portion 120*a*, a second rear insulating portion 120*b* and a front insulating portion 120*c*. The first rear insulating portion 120*a* retains the first terminals 110*a* via an insert-molding process or an assembly process, and the second rear insulating portion 120*b* retains the second terminals 110*b* via an insert-molding process or an assembly process. The first rear insulating portion 120*a* and the second rear insulating portion 120*b* are assembled with each other and then the first rear insulating portion 120*a* and the second rear insulating portion 120*b* are assembled into the front insulating portion 120*c* such that the first terminals 110*a* and the second terminals 110*b* are accommodated in the front insulating portion 120*c*.

Referring to FIG. 2 and FIG. 3, in the embodiment, the electrical plug connector 100 further includes a pair of grounding latches 130, a pair of shielding springs 140 and a shielding shell 150. The pair of grounding latches 130 is installed to the insulator (i.e., front insulating portion 120*c*), and respectively located on both sides of the terminals (i.e., the first terminals 110*a* and the second terminals 110*b*) to be latched with the electrical receptacle connector 200. The shielding spring 140 is installed to the insulator (i.e., front insulating portion 120*c*) to be in contact with the electrical receptacle connector 200. The shielding shell 150 accommodates the terminals (i.e., the first terminals 110*a* and the second terminals 110*b*), the insulator (i.e., the first rear insulating portion 120*a*, the second rear insulating portion 120*b* and the front insulating portion 120*c*), the pair of grounding latches 130 and the pair of shielding springs 140.

Referring to FIG. 2 and FIG. 3, in the embodiment, the insulator (i.e., the front insulating portion 120*c*) has a fitting protrusion 122. The shielding spring 140 has a fitting slot 142, the fitting protrusion 122 fits with the fitting slot 142, the openings 121 are away from one end of the insulator (i.e., first rear insulating portion 120*a*, a second rear insulating portion 120*b*) and penetrated into the interior of the insulator (i.e., front insulating portion 120*c*) and the openings 121 are located near the fitting protrusion 122. Additionally, the electrical plug connector 100 further includes a shielding plate 132 installed to the insulator (i.e., front insulating portion 120*c*) and located between the first terminals 110*a* and the second terminals 110*b*. In the embodiment, the shielding plate 132 and the pair of grounding latches 130 are formed integrally and hence the shielding plate 132 can be used as a grounding plate, but the disclosure is not limited thereto. In other embodiments, the pair of grounding latches 130 and the shielding plate 132 may be a plurality of independent components.

Referring to FIG. 3, in the embodiment, each of the terminals (i.e., each of the first terminals 110*a* or each of the second terminals 110*b*) has a contacting segment 111, an elastic segment 112, a fixing segment 113 and a soldering segment 114. The contacting segment 111 is configured to be in contact with a pad 204 on a tongue portion 202 of the electrical receptacle connector 200 (shown in FIG. 5). The elastic segment 112 is located between the corresponding contacting segment 111 and the corresponding fixing segment 113 to provide elastic stress to the contacting segment 111 relative to the fixing segment 113. The fixing segment 113 is fixed in the insulator (i.e., first rear insulating portion 120*a* or second rear insulating portion 120*b*). The soldering segment 114 is configured to be soldered to the circuit board.

Figure 5:
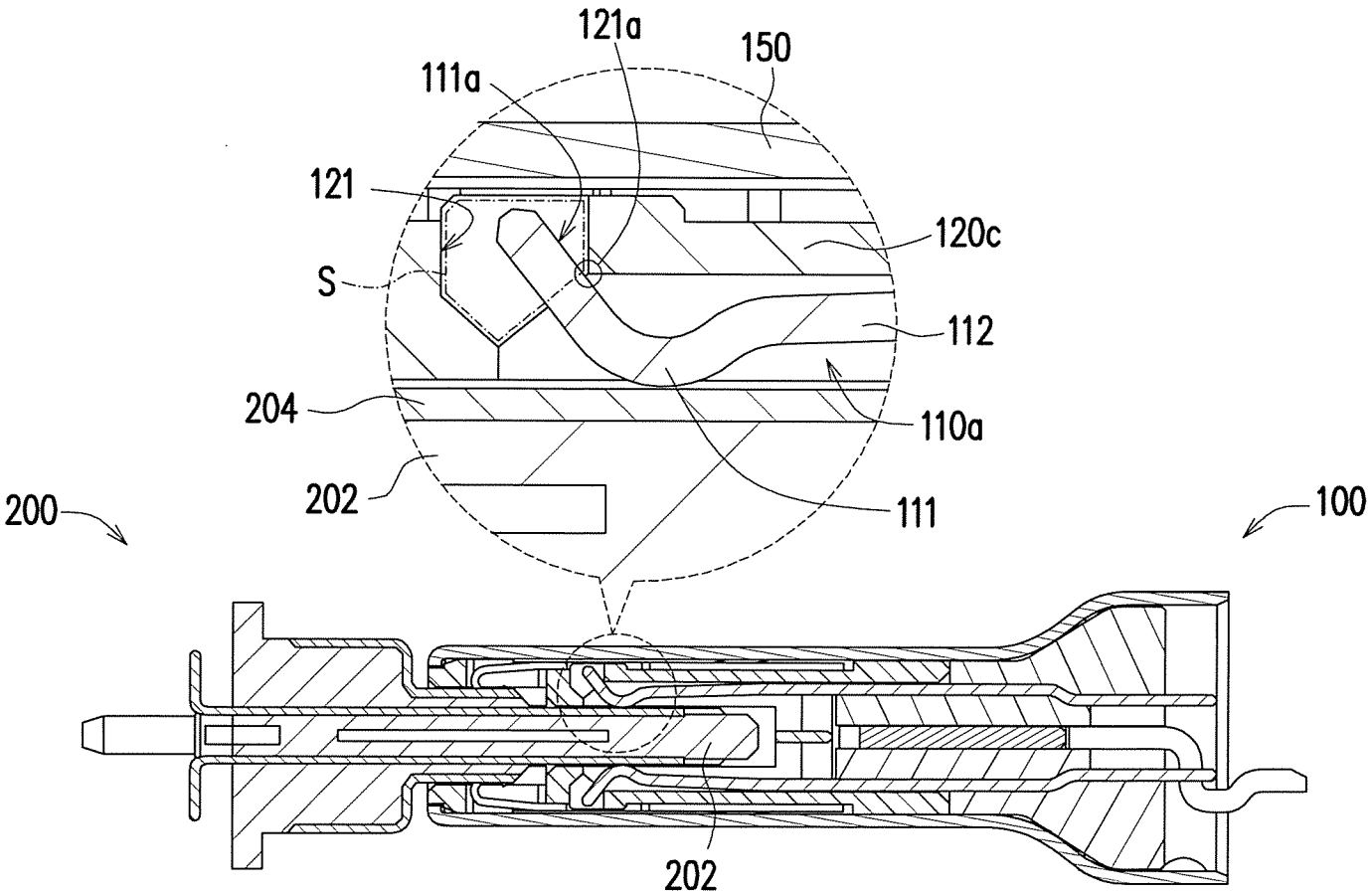
FIG. 5 is a cross-sectional view of the electrical plug connector in FIG. 4 inserted into an electrical receptacle connector.

Referring to FIG. 3 to FIG. 5, additionally, to avoid that the contacting segment 111 of each of the terminals (i.e., each of the first terminals 110*a* or each of the second terminals 110*b*) is in contact with the shielding shell 150 after being moved when the electrical plug connector 100 is inserted into the electrical receptacle connector 200, each of the contacting segments 111 has a stopping face 111*a*, and the insulator (i.e., front insulating portion 120*c*) has a plurality of stopping edges 121*a* configured to be respectively against the stopping faces 111*a* to limit the positions of the contacting segments 111 relative to the insulator (i.e., front insulating portion 120*c*).

As shown in FIG. 3, when the electrical plug connector 100 is not inserted into the electrical receptacle connector 200, each of the contacting segments 111 is not in contact with the insulator (i.e., front insulating portion 120*c*). As shown in FIG. 4 and FIG. 5, when the electrical plug connector 100 is inserted into the electrical receptacle connector 200, shape deformation of each of the elastic segments 112 shifts the corresponding contacting segment 111 until the corresponding stopping edge 121*a* is against the corresponding stopping face 111*a*, and each of the contacting segments 111 does not protrude from the insulator (i.e., front insulating portion 120*c*) to avoid contacting the shielding shell 150. Moreover, as shown in FIG. 3, when the electrical plug connector 100 is not inserted into the electrical receptacle connector 200, shape recovery of each of the elastic segments 112 restores the corresponding contacting segment 111 and the corresponding stopping edge 121*a* is away from the corresponding stopping face 111*a*.

Referring to FIG. 2 and FIG. 3, in the embodiment, the insulator (i.e., front insulating portion 120*c*) has a plurality of openings 121 to avoid that each of the terminals (i.e., each of the first terminals 110*a* or each of the second terminals 110*b*) is structurally interfered with the insulator (i.e., front insulating portion 120*c*) when being moved. In the embodiment, one end of each of the openings 121 adjacent to the interior of the insulator (i.e., front insulating portion 120*c*) forms the corresponding stopping edge 121*a*.

As shown in FIG. 3, when the electrical plug connector 100 is not inserted into the electrical receptacle connector 200, each of the contacting segments 111 is not located in a space S enclosed by the corresponding opening 121. As shown in FIG. 5, when the electrical plug connector 100 is inserted into the electrical receptacle connector 200, each of the contacting segments 111 is moved in the space S enclosed by the corresponding opening 121. Also, as shown in FIG. 3, when the electrical plug connector 100 is not inserted into the electrical receptacle connector 200, each of the contacting segments 111 is moved out of the space S enclosed by the corresponding opening 121.

Referring to FIG. 3, in the embodiment, the insulator is divided into three structurally independent components, namely the first rear insulating portion 120*a*, the second rear insulating portion 120*b* and the front insulating portion 120*c*. In other embodiments, the insulator may consist of two independent components or a single component.

Figure 6:
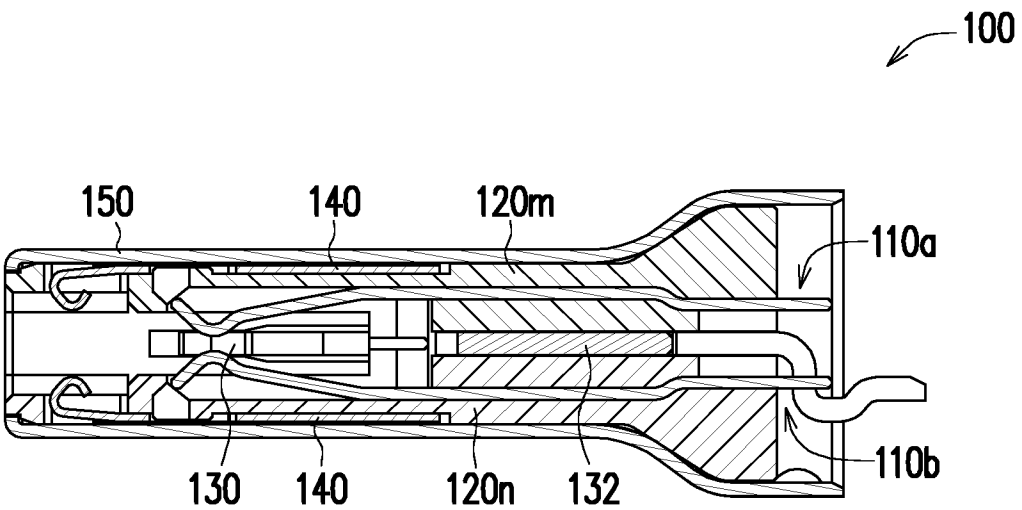
FIG. 6 is a cross-sectional view of an electrical plug connector according to another embodiment of the disclosure.

Referring to FIG. 6, different from the insulator in the embodiment of FIG. 3 which is constructed by three independent components, the insulator of the electrical plug connector 100 in the embodiment of FIG. 6 includes a first insulating portion 120*m* and a second insulating portion 120*n*. The first terminals 110*a* are fixed on the first insulating portion 120*m*, the second terminals 110*b* are fixed on the second insulating portion 120*n*, and the first insulating portion 120*m* and the second insulating portion 120*n* are assembled together.

Figure 7:
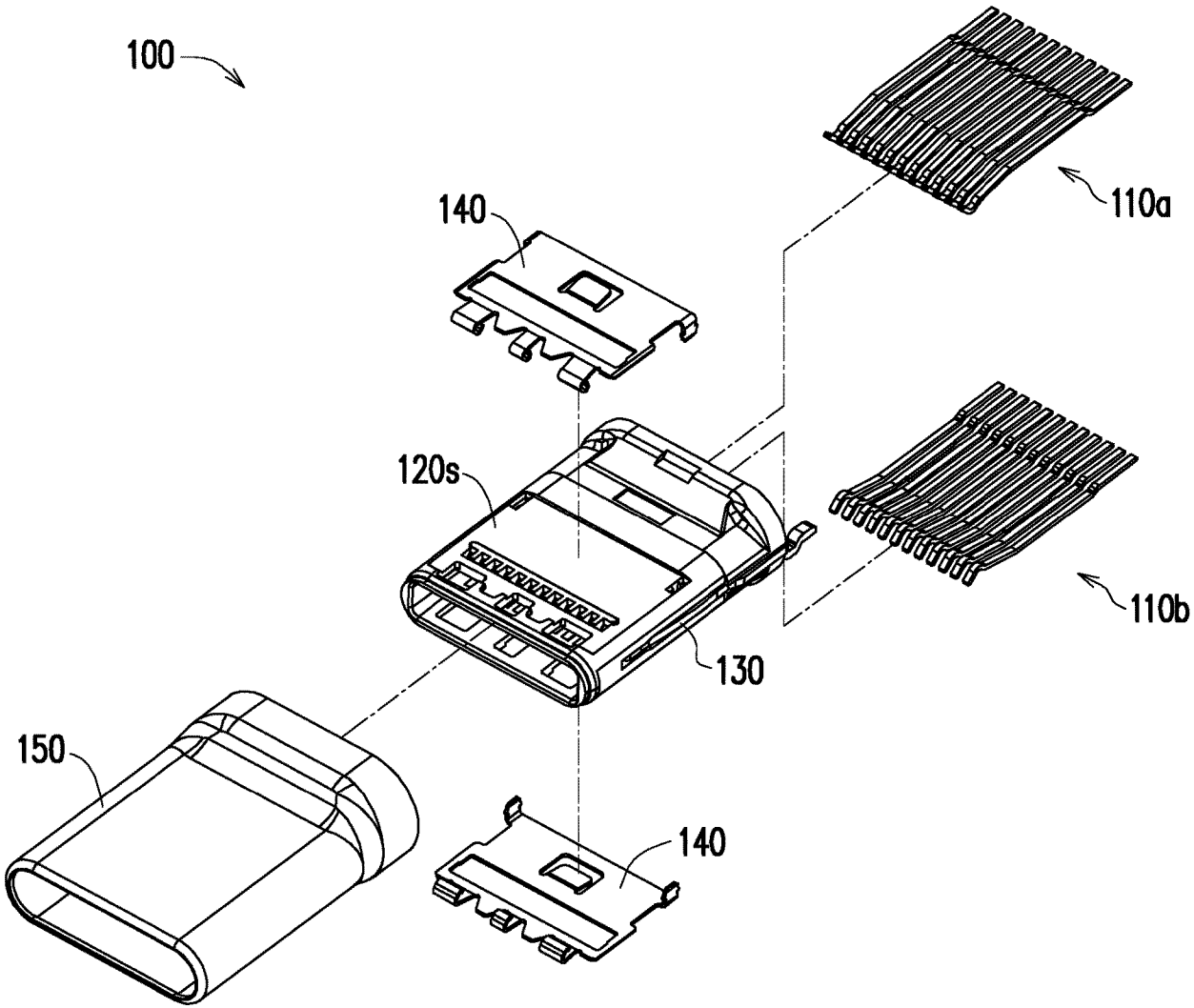
FIG. 7 is a perspective view of an electrical plug connector according to another embodiment of the disclosure.

Referring to FIG. 7, different from the insulator in the embodiments of FIG. 3 and FIG. 6 which are constructed by three and two independent components respectively, the electrical plug connector 100 in the embodiment of FIG. 7 uses a single insulator 120*s*, and the first terminals 110*a* and the second terminals 110*b* are installed to the single insulator 120*s*.

In summary, according to the disclosure, the contacting segment of the terminal is shifted until the stopping edge of the insulator is against the stopping face of the contacting segment such that the contacting segment does not protrude from the insulator to avoid contacting the shielding shell. In this manner, as compared with related art, the disclosure does not require the insulating film and thus the problems caused by use of insulating film to block the contacting segment of the terminal from the shielding shell can be avoided.

Although the disclosure has been disclosed by the above embodiments, the embodiments are not intended to limit the disclosure. It will be apparent to those skilled in the art that various modifications and variations can be made to the structure of the disclosure without departing from the scope or spirit of the disclosure. Therefore, the protecting range of the disclosure falls in the appended claims.

What is claimed is:

1. An electrical plug connector adapted to be inserted into an electrical receptacle connector, comprising:

a plurality of terminals, each of the terminals having a contacting segment and an elastic segment, wherein each of the contacting segments has a stopping face;

an insulator partially covering the terminals and having a plurality of stopping edges, wherein when the electrical plug connector is inserted into the electrical receptacle connector, shape deformation of each of the elastic segments shifts the corresponding contacting segment until the corresponding stopping edge is against the corresponding stopping face, and each of the contacting segments is away from the shielding shell, and when the electrical plug connector is withdrawn from the electrical receptacle connector, shape recovery of each of the elastic segments restores the corresponding contacting segment and the corresponding stopping edge is away from the corresponding stopping face;

a pair of grounding latches installed to the insulator and respectively located on both sides of the terminals to be latched with the electrical receptacle connector;

and a shielding shell accommodating the terminals, the insulator and the pair of grounding latches.

2. The electrical plug connector according to claim 1, wherein the insulator has a plurality of openings, and an end of each of the openings adjacent to an interior of the insulator forms the corresponding stopping edge.

3. The electrical plug connector according to claim 2, wherein when the electrical plug connector is inserted into the electrical receptacle connector, each of the contacting segments is moved into a space enclosed by the corresponding opening, and when the electrical plug connector is withdrawn from the electrical receptacle connector, each of the contacting segments is moved out of the space enclosed by the corresponding opening.

4. The electrical plug connector according to claim 1, further comprising:

a shielding plate installed to the insulator, wherein the terminals comprise a plurality of first terminals and a plurality of second terminals and the shielding plate is located between the first terminals and the second terminals.

5. The electrical plug connector according to claim 4, wherein the shielding plate and the pair of grounding latches are formed integrally.

6. The electrical plug connector according to claim 1, wherein the terminals comprise a plurality of first terminals and a plurality of second terminals, the insulator comprises a first rear insulating portion, a second rear insulating portion and a front insulating portion, the first rear insulating portion retains the first terminals, the second rear insulating portion retains the second terminals, and the first rear insulating portion and the second rear insulating portion are assembled with each other and then the first rear insulating portion and the second rear insulating portion are assembled into the front insulating portion such that the first terminals and the second terminals are accommodated in the front insulating portion.

7. The electrical plug connector according to claim 1, wherein the terminals comprise a plurality of first terminals and a plurality of second terminals, the insulator comprises a first insulating portion and a second insulating portion, the first terminals are fixed on the first insulating portion, the second terminals are fixed on the second insulating portion, and the first insulating portion and the second insulating portion are assembled together.

8. The electrical plug connector according to claim 1, wherein each of the terminals has a fixing segment and a soldering segment, and the elastic segment is located between the corresponding contacting segment and the corresponding fixing segment.

9. The electrical plug connector according to claim 1, a shielding spring installed to the insulator to be in contact with the electrical receptacle connector, wherein the shielding shell accommodates the terminals, the insulator, the shielding spring and the pair of grounding latches.

10. The electrical plug connector according to claim 9, wherein the insulator has a fitting protrusion, the shielding spring has a fitting slot, the fitting protrusion fits with the fitting slot, and the one end of the openings away from the interior of the insulator is located at the fitting protrusion.

* * * * *